US011628981B2

(12) United States Patent
Guirguis

(10) Patent No.: US 11,628,981 B2
(45) **Date of Patent: *Apr. 18, 2023**

(54) TAMPER EVIDENT CONTAINER

(71) Applicant: Sameh Guirguis, Shelton, CT (US)

(72) Inventor: Sameh Guirguis, Shelton, CT (US)

(73) Assignee: PIANCA PACKAGING LLC, Englishtown, NJ (US)

( * ) Notice: Subject to any disclaimer, the term of this patent is extended or adjusted under 35 U.S.C. 154(b) by 214 days.

This patent is subject to a terminal disclaimer.

(21) Appl. No.: 16/752,109

(22) Filed: Jan. 24, 2020

(65) Prior Publication Data

US 2021/0229876 A1 Jul. 29, 2021

(51) Int. Cl.
*B65D 43/16* (2006.01)
*B65D 55/02* (2006.01)

(52) U.S. Cl.
CPC ..... *B65D 43/162* (2013.01); *B65D 55/024* (2013.01); *B65D 2401/60* (2020.05); *B65D 2543/00194* (2013.01); *B65D 2543/00203* (2013.01); *B65D 2543/00296* (2013.01); *B65D 2543/00518* (2013.01); *B65D 2543/00546* (2013.01); *B65D 2543/00629* (2013.01); *B65D 2543/00685* (2013.01)

(58) Field of Classification Search
CPC ..... B65D 17/00; B65D 55/06; B65D 43/162; B65D 55/024; B65D 2401/60
See application file for complete search history.

(56) References Cited

U.S. PATENT DOCUMENTS

| | | | | |
|---|---|---|---|---|
| 2,941,660 | A * | 6/1960 | Tupper | B65D 43/0274 220/277 |
| 5,040,695 | A | 8/1991 | Adams | |
| 5,788,105 | A * | 8/1998 | Foos | B65D 43/162 220/266 |
| 7,118,003 | B2 | 10/2006 | Sellari | |
| 8,028,851 | B2 | 10/2011 | Vovan | |
| 8,640,914 | B2 | 2/2014 | Meyer | |
| 8,672,166 | B2 | 3/2014 | Nazareth | |
| 8,833,589 | B2 | 9/2014 | Vovan | |
| 9,102,446 | B2 | 8/2015 | Kowal | |
| 9,187,209 | B1 | 11/2015 | Hanna | |
| 9,278,786 | B2 | 3/2016 | Vovan | |
| 9,315,302 | B2 | 4/2016 | Stone | |
| 9,527,633 | B2 | 12/2016 | Chen | |

(Continued)

FOREIGN PATENT DOCUMENTS

WO 2018211538 11/2018

*Primary Examiner* — Jeffrey R Allen
(74) *Attorney, Agent, or Firm* — Ziegler IP Law Group

(57) ABSTRACT

A. tamper evident container includes a cover having a first interlocking flange with a first tab for opening and closing the container and a first extension joined to the first tab along a frangible score line, a base having a second interlocking flange with a second tab for opening and closing the container and a second extension joined to the second tab along a frangible score line, the first extension including one or more first interlocking elements and the second extension including one or more second interlocking elements, where the first and second interlocking elements, when securely fastened together, prevent access to the first and second tabs, and require more force to separate than to sever the first and second extensions along the frangible score lines.

18 Claims, 5 Drawing Sheets

(56) References Cited

U.S. PATENT DOCUMENTS

| | | | | |
|---|---|---|---|---|
| 9,546,018 | B1 | 1/2017 | Vovan | |
| 9,561,885 | B1 | 2/2017 | Studee | |
| 9,656,785 | B2 | 5/2017 | Cimmerer | |
| 9,676,527 | B2 | 6/2017 | McCumber | |
| 9,708,106 | B2 | 7/2017 | Vovan | |
| 9,950,845 | B2 | 4/2018 | Hsieh | |
| 9,994,369 | B2 | 6/2018 | Myer | |
| 10,220,986 | B2 | 3/2019 | Petlak | |
| 10,266,312 | B2 | 4/2019 | Fosse | |
| 10,279,962 | B2 | 5/2019 | Hansen | |
| 10,301,080 | B2 | 5/2019 | Lotfi | |
| 10,384,843 | B2 | 8/2019 | Vovan | |
| 2005/0184070 | A1* | 8/2005 | Boback | B65D 43/021 220/266 |
| 2007/0045317 | A1 | 3/2007 | Rosender | |
| 2007/0138180 | A1 | 6/2007 | Vovan | |
| 2009/0206082 | A1 | 8/2009 | Vovan | |
| 2011/0000929 | A1 | 1/2011 | Brown | |
| 2011/0031246 | A1 | 2/2011 | Massey, Jr. | |
| 2012/0005994 | A1 | 1/2012 | Tidball | |
| 2012/0103990 | A1 | 5/2012 | McCumber | |
| 2012/0181280 | A1 | 7/2012 | Parbier | |
| 2012/0187122 | A1 | 7/2012 | Glasow | |
| 2013/0020325 | A1 | 1/2013 | Stone | |
| 2013/0160406 | A1 | 6/2013 | Johnston | |
| 2013/0320015 | A1 | 12/2013 | Dyble | |
| 2014/0041343 | A1 | 2/2014 | Corbett | |
| 2014/0138383 | A1 | 5/2014 | Lisowy | |
| 2014/0209607 | A1 | 7/2014 | Fosse | |
| 2014/0224803 | A1 | 8/2014 | Pickering | |
| 2015/0028033 | A1 | 1/2015 | Samuel | |
| 2015/0060455 | A1 | 3/2015 | Chou | |
| 2015/0083725 | A1 | 3/2015 | Sinha | |
| 2015/0060454 | A1 | 5/2015 | Kowal | |
| 2015/0266611 | A1 | 9/2015 | Dow | |
| 2015/0307239 | A1 | 10/2015 | Chen | |
| 2016/0023815 | A1 | 1/2016 | Siskindovich | |
| 2017/0088316 | A1 | 3/2017 | Krueger | |
| 2017/0275059 | A1 | 9/2017 | Lotfi | |
| 2018/0079562 | A1 | 3/2018 | Croft | |
| 2018/0194523 | A1 | 7/2018 | Plummer | |
| 2018/0215517 | A1 | 8/2018 | Vovan | |
| 2018/0273254 | A1 | 9/2018 | Hansen | |
| 2018/0273285 | A1 | 9/2018 | Bergeron | |
| 2018/0327148 | A1 | 11/2018 | Trahan | |
| 2019/0009955 | A1 | 1/2019 | Schwester | |
| 2019/0144171 | A1* | 5/2019 | Schoen | B65D 43/0254 220/266 |

* cited by examiner

TAMPER EVIDENT CONTAINER

FIELD

The present disclosure relates generally to packaging and in particular to packaging that provides a clear indication in the event of tampering.

BACKGROUND

Various consumer products are typically packaged in containers. Generally, the consumer desires that the containers remain intact in order to preserve the value of the goods contained therein. Proving evidence of container tampering, or evidence that the container has previously been opened, would be advantageous in maintaining the quality and value of the packaged goods.

SUMMARY

In at least one aspect, the disclosed embodiments are directed to a tamper evident container including a cover having a first interlocking flange with a first tab for opening and closing the container and a first extension joined to the first tab along a frangible score line, a base having a second interlocking flange with a second tab for opening and closing the container and a second extension joined to the second tab along a frangible score line, the first extension including one or more first interlocking elements and the second extension including one or more second interlocking elements, where the first and second interlocking elements, when securely fastened together, prevent access to the first and second tabs, and require more force to separate than to sever the first and second extensions along the frangible score lines.

In at least another aspect, a method of providing a tamper evident container includes forming a cover with a first interlocking flange with a first tab for opening the container and a first extension joined to the first tab along a frangible score line, forming a base with a second interlocking flange with a second tab for opening the container and a second extension joined to the second tab along a frangible score line, providing the first extension with one or more first interlocking elements and the second extension with one or more second interlocking elements, where the first and second interlocking elements, when securely fastened together, prevent access to the first and second tabs, and require more force to separate than to sever the first and second extensions along the frangible score lines.

In at least a further aspect, a tamper evident container includes a cover having a first interlocking flange with a first tab for opening the container and a first extension joined to the first tab along a frangible score line, a second interlocking flange located on an end of the cover opposite the first interlocking flange, the second interlocking flange having a second tab for opening the container and a second extension joined to the second tab along a frangible score line, a base including a third interlocking flange with a third tab for opening the container and a third extension joined to the third tab along a frangible score line, a fourth interlocking flange located on an end of the base opposite the third interlocking flange, the fourth interlocking flange having a fourth tab for opening the container and a fourth extension joined to the fourth tab along a frangible score line, the first extension including one or more first interlocking elements, the second extension including one or more second interlocking elements, the third extension including one or more third interlocking elements and the fourth extension including one or more fourth interlocking elements, where the first and second interlocking elements, when securely fastened together, prevent access to the first and second tabs, and require more force to separate than to sever the first and second extensions along the frangible score lines, and where the third and fourth interlocking elements, when securely fastened together, prevent access to the third and fourth tabs, and require more force to separate than to sever the third and fourth extensions along the frangible score lines.

DETAILED DESCRIPTION

The disclosed embodiments are directed to providing a tamper evident container with tabs that are inaccessible until a locking mechanism is removed.

Figure 1:
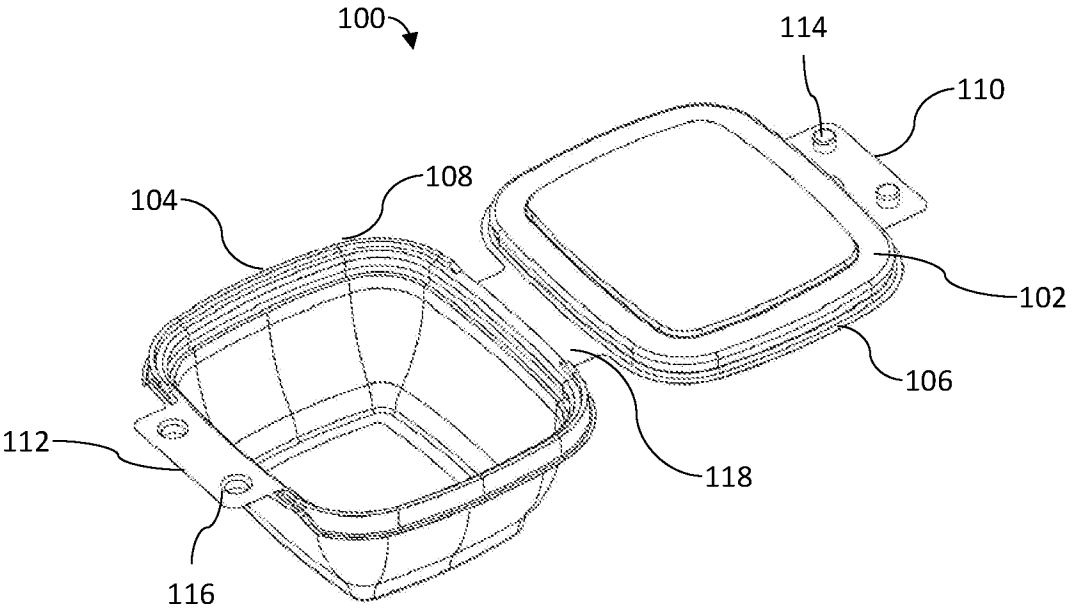
FIG. 1 shows a perspective view of an open container according to an aspect of the disclosed embodiments.

FIG. 1 shows a perspective view of a container 100 according to the disclosed embodiments. While the container 100 may be illustrated as rectangular in shape, with curved corners, it should be understood that the container 100 may be square, round, oval, or may have any appropriate shape. The container 100 may be formed from a plastic or thermoplastic material, for example, polyethylene terephthalate, polystyrene, or polypropylene, however it should be understood that the container may be constructed of any material or combination of materials suitable for providing the features of the container 100 as described herein. The container 100 may include a cover 102 and a base 104. The cover may have a peripheral edge 106 that may rest on an upper portion 108 of the base 104 when the container 100 is closed. The cover 102 and base 104 may be patterned with one or more indented or raised areas, channels, grooves, or other features that may provide structural integrity or stiffness, or a stacking feature to the container 100. The cover 102 and base 104 may also be imprinted with indicia, for example, trademarks, barcodes, or text, and may be constructed of material that is transparent, translucent, or has color.

The cover 102 and base 104 may further include respective first and second interlocking flanges 110, 112 with tabs that extend outward and with complementary frangible locking elements 114, 116. In some embodiments the cover 102 and base 104 may be connected by a hinge 118, while in other embodiments the cover 102 and base 104 may be implemented as separate pieces. In embodiments where the cover 102 and base 104 are implemented as separate pieces, the cover 102 and base 104 may have interlocking flanges on opposing sides with frangible locking elements.

Figure 2B:
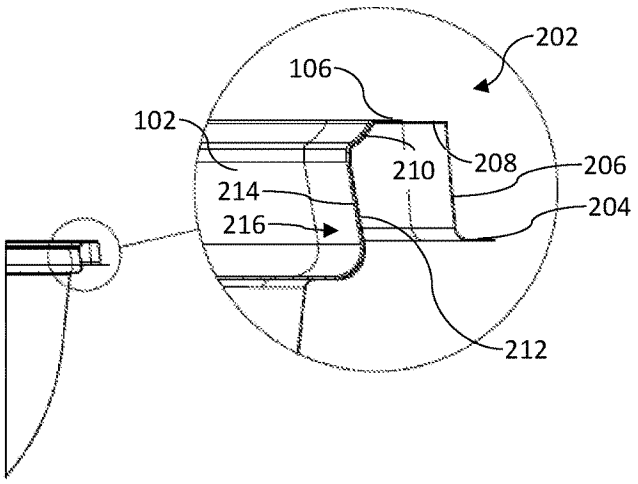
FIG. 2B shows a cross section of the rim.
Figure 2D:
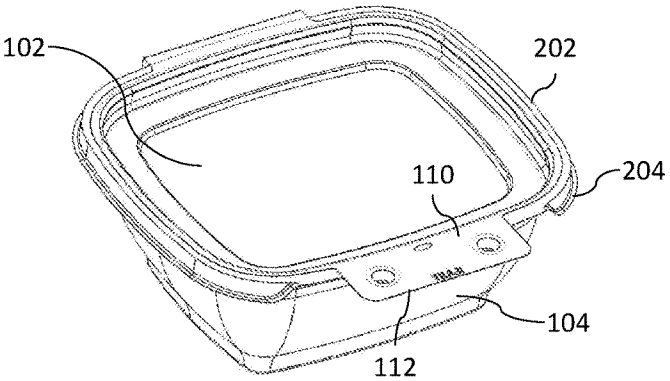
FIG. 2D illustrates the rim in place on a closed container.
Figure 2A:
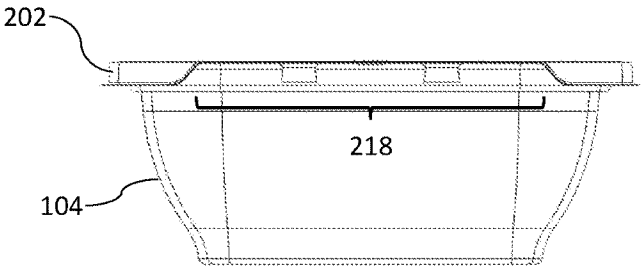
FIG. 2A shows a front view of a container base with a rim.

FIG. 2A shows a front view of the base 104. The base 104 may include an inverted U-shaped rim 202 that extends substantially around the perimeter of an upper section of the base 104. FIG. 2B shows a cross section of the rim 202 illustrating a flange portion 204, an outer wall portion 206, a flat top portion 208, a curved lead in recess 210 extending inward from the flat top portion 208 and a lower recess 212 extending from the lead in recess 206 to the body of the base 104. The peripheral edge 106 of the cover 102 may rest on or contact a part of the flat top portion 208 when the cover 102 is closed. As a result, the peripheral edge 106 of the cover 102 is rendered relatively inaccessible because the flat top portion 208 extends beyond the peripheral edge 106. When the cover 102 is closed, a rib portion 214 of the cover 102 may contact the lower recess 212 to form a leak resistant press fit seal 216. Returning to FIG. 2A, the outer wall portion 206 of the rim 202 may have a raised area 218 through which the second interlocking flange 112 extends from the flat top portion 208.

Figure 2C:
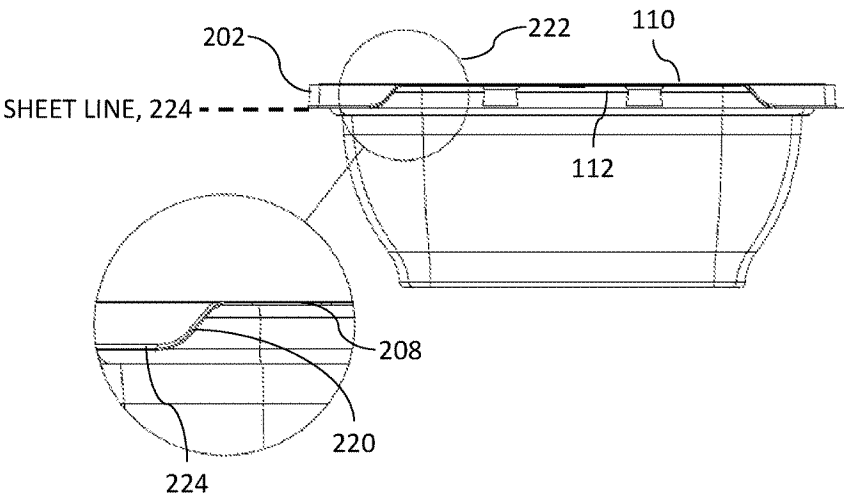
FIG. 2C shows an expanded view of a raised area of the rim.

FIG. 2C shows an expanded view of the raised area 218 of the rim including a ramp 220 positioned at sides 222 of the raised area 218, applicable to the disclosed embodiments. As shown in the expanded view, the sides 222 of the raised area 218 have a ramp 220 extending upward from a lower edge of a sheet line 224 of the rim 202 to the flat top portion 208. The profile of the rim 202 with the ramp 220 extending from a sheet line 224 starting at the flange portion 204 to the flat top portion 208 may be implemented using three dimensional (3D) trim techniques versus conventional two dimensional (2D) trim techniques that may trim the finished container at only the sheet line 224. The raised area 218 and the position of the flat top portion 208 operates to cause the first and second interlocking flanges 110, 112 to abut, one over the other, with little or no space in between, when the cover 102 is closed over the base 104 as shown in FIG. 2D. When the cover 102 is closed, the first interlocking flange 110 rests on the top flat portion 208 of the rim 202 and extends through the space between the sides 222 of the raised area 220. Correspondingly, the second interlocking flange extends from the top flat portion 208 through the raised area 218, effecting the abutment of the first and second interlocking flanges 110, 112, one over the other, with little or no space in between.

Figure 3B:
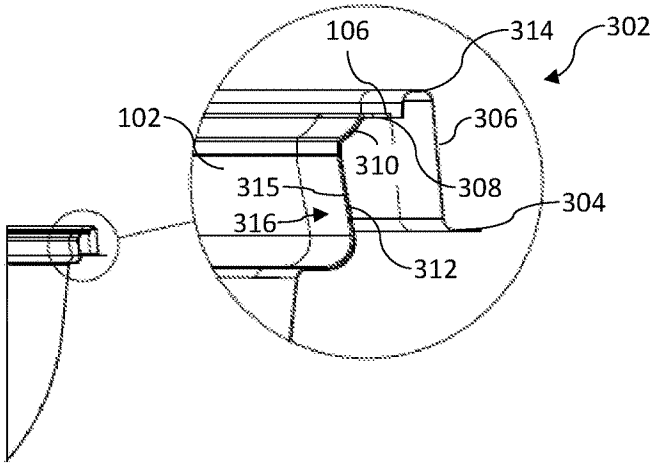
FIG. 3B shows a cross section of the alternate embodiment of the rim.
Figure 3D:
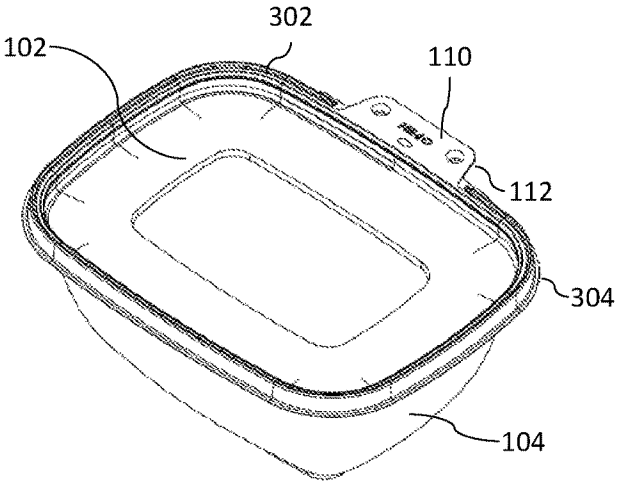
FIG. 3D illustrates the alternate embodiment of the rim in place on a closed container.
Figure 3A:
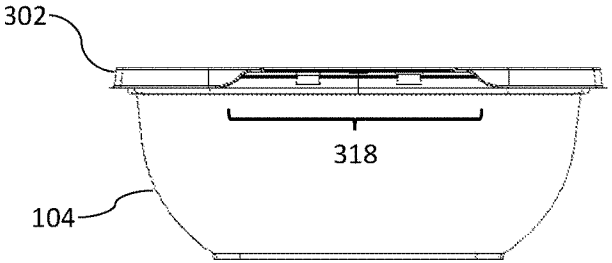
FIG. 3A shows a front view of a container base with an alternate embodiment of the rim.

FIG. 3A shows a front view of the base 104 with an alternate embodiment of the rim 302. As shown in the cross sectional view of FIG. 3B, the rim 302 includes a flange portion 304, an outer wall portion 306, a flat top portion 308, a curved lead in recess 310 extending inward from the flat top portion 308, a lower recess 312 extending from the lead in recess 310 to the body of the base 104, and a bead 314 extending upward and outward from the flat top portion 308. The peripheral edge 106 of the cover 102 may rest on or contact a part of the flat top portion 308 when the cover 102 is closed When the cover 102 is closed, a rib portion 315 of the cover 102 may contact the lower recess 312 to form a leak resistant press fit seal 316. In some embodiments of the rim 302, the bead 314 extending upward and outward from the flat top portion 308 may block access to the peripheral edge 106 edge of the cover 102 when the cover 102 is closed. The peripheral edge 106 of the cover 102 may generally be rendered even more inaccessible by the presence of the bead 314. In additional embodiments, the peripheral edge 106 of the cover 102 may extend toward and may contact the bead 314 proximate a junction of the flat top portion 308 and the bead 314. Returning to FIG. 3A, the outer wall portion 306 of the rim 302 may have a raised area 318 through which the second interlocking flange 112 extends from the flat top portion 308.

Figure 3C:
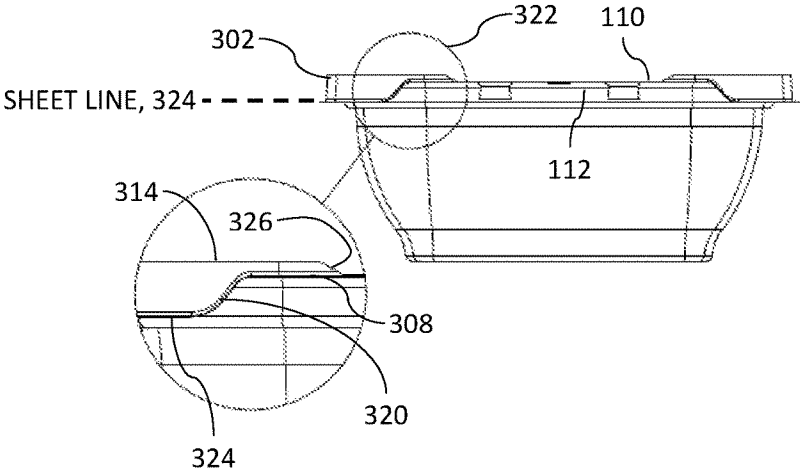
FIG. 3C shows an expanded view of a raised area of the alternate embodiment of the rim.

FIG. 3C shows an expanded view of a ramp 320 positioned at sides 322 of the raised area 318 of the outer wall portion 306 of the rim 302 applicable to the disclosed embodiments. As shown in the expanded view, the sides of the raised area 318 have a ramp 320 extending upward from a lower edge of a sheet line 324 of the rim 302, to the flat top portion 308, and an upper relief 326 extending downward from the bead 314 of the rim 302 to the flat top portion 308. The profile of the rim 302 with the ramp 320 extending from the sheet line 324 to the flat top portion 308 may be implemented using 3D trim techniques versus conventional 2D trim techniques that may trim the finished container at only the sheet line 324. The raised area 318 and the position of the flat top portion 308 operate to cause the first and second interlocking flanges 110, 112 to abut, one over the other, with little or no space in between, when the cover 102 is closed over the base 104 as shown in FIG. 3D. When the cover 102 is closed, the first interlocking flange 110 rests on the top flat portion 308 of the rim and extends through the space between upper relief 326 on both sides of the raised area 318. Correspondingly, the second interlocking flange extends from the top flat portion 308 through the raised area 318, effecting the abutment of the first and second interlocking flanges 110, 112, one over the other, with little or no space in between.

Figure 4:
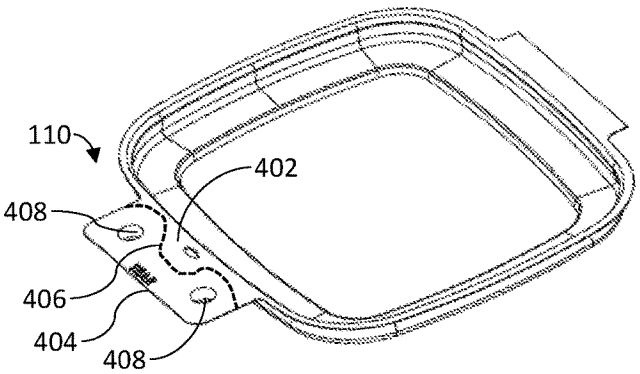
FIG. 4 depicts features of an interlocking flange on a cover of the container.

FIG. 4 depicts features of the first interlocking flange 110 of the cover 102. The first interlocking flange 110 includes a first tab 402 and a first extension 404 joined to the first tab 402 along a first score line 406. The first score line 406 may be in the form of a series of perforations that may separate upon the application of force. The first extension 404 includes first interlocking elements 408.

Figure 5:
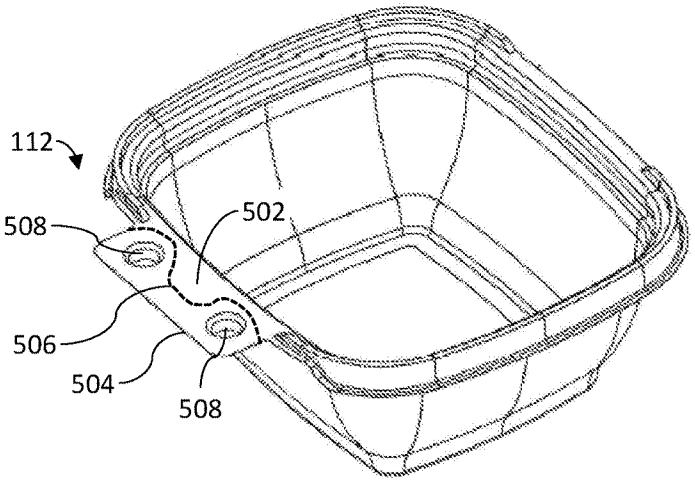
FIG. 5 depicts features of an interlocking flange on a base of the container.

FIG. 5 depicts features of the second interlocking flange 112 of the base 104. The second interlocking flange 112 includes a second tab 502 and a second extension 504 joined to the second tab 502 along a second score line 506. The second score line may also be in the form of a series of perforations that may separate upon the application of force. The second extension 504 includes second interlocking elements 508. When the first and second extensions 404, 504, are separated from the first and second tabs 402, 502, the first and second tabs 402, 502 remain attached to the cover 102 and the base 104, respectively, and may be used to open and optionally close the container.

The interlocking elements 408, 508 while shown as cylindrical, may have any shape that may allow the interlocking elements 408, 508 to securely fasten together. In some embodiments first interlocking elements 408 may be male interlocking elements extending downward, while second interlocking elements 508 may be female interlocking elements with receptacles capable of receiving male interlocking elements, while in other embodiments, the first interlocking elements 408 may be female interlocking elements and the second interlocking elements 508 may be male interlocking elements. In still other embodiments, the first interlocking elements 408 may include a female interlocking element and a male interlocking element and the second interlocking elements 508 may include a corresponding male interlocking element and a female interlocking element. The first and second interlocking elements may have an interference fit, or any other suitable fit, that when securely fastened together, requires more force to separate than to sever the first and second extensions 404, 504 along the first and second score lines 406, 506.

Figure 6:
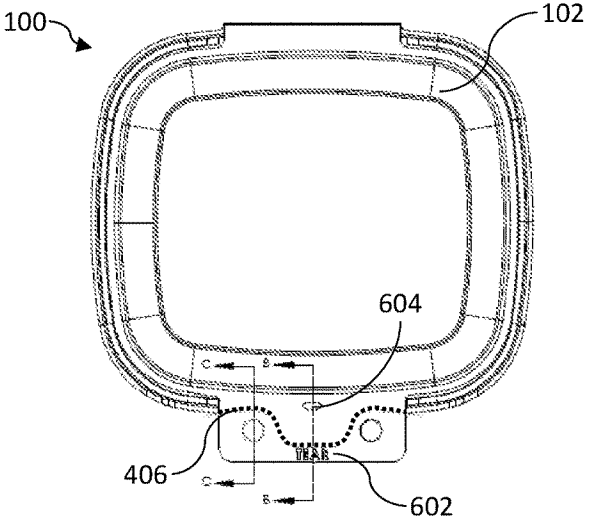
FIG. 6 shows top and partial cross sectional views of a container with interlocking elements securely fastened together.
Figure 6:
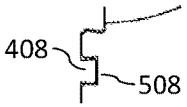
Figure 6:
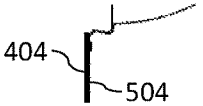

FIG. 6 shows top and partial cross sectional views of the container 100 with the first and second extensions 404, 504 fastened together by way of fastening the interlocking elements 408, 508 securely together. When the first and second extensions 404, 504 are securely fastened together, the first interlocking flange 110 rests on the top flat portion 208, 308 of the rim and extends through the space between the sides of the raised area 218, 318. Also when the extensions 404, 504 are securely fastened together, the second interlocking flange extends from the top flat portion 208, 308 through the raised area 218, 318, and the first and second interlocking flanges 110, 112, abut each other, one over the other, with little or no space in between making access to the locking flanges to separate them apart relatively difficult, preventing access to the tabs 402, 502, and preventing the opening of the container and any tampering with the contents without removing the locking elements.

The first interlocking flange 110 may include an indication 602 as to where to apply force to the securely fastened first and second extensions 404, 504 for removing the first and second extensions 404, 504. Because the force required to separate the interlocking elements 110, 112 is greater than a force that severs the first and second extensions 404, 504 along the score lines 406, 506, the securely fastened first and second extensions 404, 504 will separate along the score lines 406, 506 as a unit from the first and second tabs 402, 502 to clearly provide an indication that the container 100 has been opened, or at least an attempt has been made to open the container 100. One or both of the first and second tabs 402, 502 may have a protrusion 604 that may hold the interlocking flanges 110, 112 apart to facilitate finger access to open the container when the securely fastened first and second extensions 404, 504 have been separated along the score lines 406, 506 as a unit from the first and second tabs 402, 502.

In some embodiments, the cover 102 and base 104 may be configured such that they may be repetitively mated by closing the cover 102 over the base 104 such that the rib portion 214, 315 contacts the lower recess 212, 312 to form the leak resistant press fit seal 216, 316 without securely fastening the interlocking elements 408, 508 together. This may allow the container 100 to be repetitively filled and closed, for example with different foodstuffs, and then securely closing the container 100 by securely fastening the interlocking elements 408, 508 together, hereby activating the tamper evident features, when the filling operations are complete.

Figure 7B:
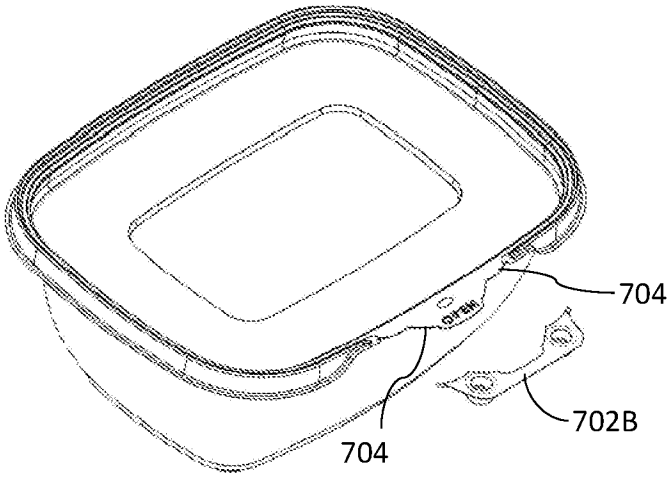
FIG. 7B shows securely fastened interlocking flanges separated as a unit from a container embodiment having no hinge.
Figure 7A:
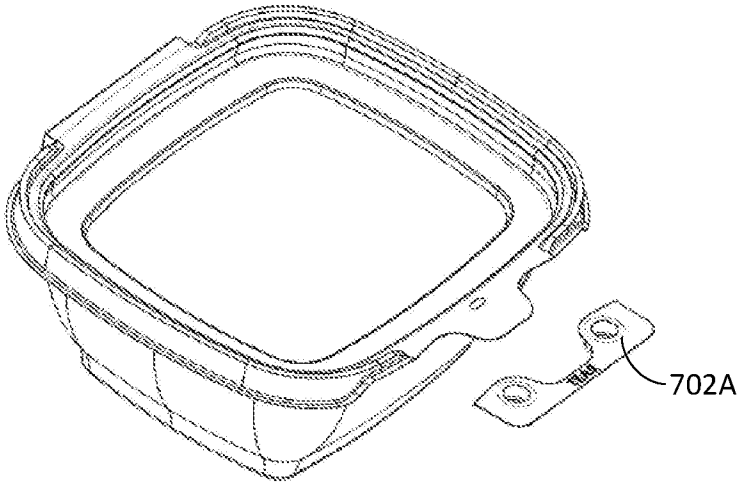
FIG. 7A shows securely fastened interlocking flanges separated as a unit from a container embodiment having a hinge.

FIG. 7A shows the securely fastened extensions 404, 504 separated as a unit 702A from an embodiment of the container 100 having a hinge, while FIG. 7B shows the securely fastened extensions 404, 504 separated as a unit 702B from an embodiment of the container 100 having no hinge where the cover 102 and base 104 are implemented as separate pieces. Also, as shown in FIG. 7B, the score lines 406, 506 may include irregularities that result in outcroppings, projections, or other indications 704 that show evidence of missing extensions 404, 504.

The disclosed embodiments allow for the use of various container configurations including hinged containers and containers with separate covers and bases. The interlocking flanges are frangible with locking elements that require significant force to separate over and above the force required to separate the first and second extensions along the score lines in the lid and base, providing an easily discernable indication that the container has been opened. The rim has specific features that allow the interlocking flanges to abut, or lay flat together, one over the other, with little or no space between, which prevents access to the tabs of the interlocking flanges, without removing the securely fastened interlocking elements as a unit.

It is noted that the embodiments described herein can be used individually or in any combination thereof. It should be understood that the foregoing description is only illustrative of the embodiments. Various alternatives and modifications can be devised by those skilled in the art without departing from the embodiments. Accordingly, the present embodiments are intended to embrace all such alternatives, modifications and variances that fall within the scope of the appended claims.

Various modifications and adaptations may become apparent to those skilled in the relevant arts in view of the foregoing description, when read in conjunction with the accompanying drawings. However, all such and similar modifications of the teachings of the disclosed embodiments will still fall within the scope of the disclosed embodiments.

Various features of the different embodiments described herein are interchangeable, one with the other. The various described features, as well as any known equivalents can be mixed and matched to construct additional embodiments and techniques in accordance with the principles of this disclosure.

Furthermore, some of the features of the exemplary embodiments could be used to advantage without the corresponding use of other features. As such, the foregoing description should be considered as merely illustrative of the principles of the disclosed embodiments and not in limitation thereof.

What is claimed is:

1. A tamper evident container comprising:

a cover comprising a first interlocking flange with a first tab for opening the container and a first extension joined to the first tab along a frangible score line;

a base comprising a second interlocking flange with a second tab for opening the container and a second extension joined to the second tab along a frangible score line;

the first extension including one or more first interlocking elements and the second extension including one or more second interlocking elements, wherein the first and second interlocking elements, when securely fastened together, prevent access to the first and second tabs, the tamper evident container further comprising a rim extending substantially around an uppermost perimeter of the base, the rim having an uppermost flat top portion, wherein a peripheral edge of the cover contacts a part of the uppermost flat top portion and the uppermost flat top portion extends beyond the peripheral edge when the cover is closed over the base.

2. The tamper evident container of claim 1, wherein the rim includes an outer wall portion, a curved lead in recess extending inward from the uppermost flat top portion and a lower recess extending from the lead in recess to a body of the base.

3. The tamper evident container of claim 2, wherein the rim further comprises a flange extending from the rim and a raised area with ramps extending from a sheet line of the flange to the uppermost flat top portion, wherein a profile of the ramps extending from the sheet line to the uppermost flat top portion is implemented using three dimensional trim techniques.

4. The tamper evident container of claim 3, wherein the second interlocking flange extends from the top flat portion through the raised area, wherein when the first and second extensions are securely fastened together, the first interlocking flange rests on the top flat portion of the rim and the first and second interlocking flanges abut each other, one over the other in order to prevent access to the first and second tabs.

5. The tamper evident container of claim 2, wherein the rim further comprises a bead protruding upward from the uppermost flat top portion, the bead configured to block access to a peripheral edge of the cover contacting a part of the uppermost flat top portion when the cover is closed over the base.

6. The tamper evident container of claim 1, wherein the first and second extensions are configured to separate along the frangible score lines as a unit from the first and second tabs to provide an indication that tampering of the container has occurred.

7. The tamper evident container of claim 1, wherein one or more of the first and second tabs include a protrusion positioned to space the interlocking flanges apart when the first and second extensions are separated along the frangible score lines as a unit from the first and second tabs.

8. The tamper evident container of claim 1, further comprising a hinge connecting the cover and the base.

9. The tamper evident container of claim 1, wherein the cover and base comprise a plastic material including one or more of high density polyethylene, polyethylene terephthalate, polystyrene, or polypropylene.

10. A method of providing a tamper evident container comprising:

forming a cover with a first interlocking flange with a first tab for opening the container and a first extension joined to the first tab along a frangible score line;

forming a base with a second interlocking flange with a second tab for opening the container and a second extension joined to the second tab along a frangible score line;

providing the first extension with one or more first interlocking elements and the second extension with one or more second interlocking elements, wherein the first and second interlocking elements, when securely fastened together, prevent access to the first and second tabs;

the method further comprising forming a rim extending substantially around an uppermost perimeter of the base, the rim having an uppermost flat top portion, wherein a peripheral edge of the cover contacts a part of the uppermost flat top portion and the uppermost flat top portion extends beyond the peripheral edge when the cover is closed over the base.

11. The method of claim 10, wherein the rim includes an outer wall portion, a curved lead in recess extending inward from the uppermost flat top portion and a lower recess extending from the lead in recess to a body of the base.

12. The method of claim 11, further comprising forming the rim with a flange and a raised area with ramps extending from a sheet line of the flange to the uppermost flat top portion, and implementing a profile of the ramps extending from the sheet line to the uppermost flat top portion using three dimensional trim techniques.

13. The method of claim 12, wherein the second interlocking flange extends from the top flat portion through the raised area, wherein when the first and second extensions are securely fastened together, the first interlocking flange rests on the top flat portion of the rim and the first and second interlocking flanges abut each other, one over the other in order to prevent access to the first and second tabs.

14. The method of claim 11, further comprising forming the rim with a bead protruding upward from the uppermost flat top portion, the bead configured to block access to a peripheral edge of the cover contacting a part of the uppermost flat top portion when the cover is closed over the base.

15. The method of claim 10, wherein the first and second extensions are configured to separate along the frangible score lines as a unit from the first and second tabs to provide an indication that tampering of the container has occurred.

16. The method of claim 10, comprising forming one or more of the first and second tabs with a protrusion positioned to space the interlocking flanges apart when the first and second extensions are separated along the frangible score lines as a unit from the first and second tabs.

17. The method of claim 10, comprising, forming the container from a plastic material including one or more of high density polyethylene, polyethylene terephthalate, polystyrene, or polypropylene.

18. A tamper evident container comprising:

a cover comprising:

a first interlocking flange with a first tab for opening the container and a first extension joined to the first tab along a frangible score line;

a second interlocking flange located on an end of the cover opposite the first interlocking flange, the second interlocking flange having a second tab for opening the container and a second extension joined to the second tab along a frangible score line;

a base comprising:

a third interlocking flange with a third tab for opening the container and a third extension joined to the third tab along a frangible score line, a fourth interlocking flange located on an end of the base opposite the third interlocking flange, the fourth interlocking flange having a fourth tab for opening the container and a fourth extension joined to the fourth tab along a frangible score line; and a rim extending substantially around an uppermost perimeter of the base, the rim having an uppermost flat top portion, wherein a peripheral edge of the cover contacts a part of the uppermost flat top portion and the uppermost flat top portion extends beyond the peripheral edge when the cover is closed over the base, the first extension including one or more first interlocking elements, the second extension including one or more second interlocking elements, the third extension including one or more third interlocking elements and the fourth extension including one or more fourth interlocking elements, wherein the first and second interlocking elements, when securely fastened together, prevent access to the first and second tabs, and wherein the third and fourth interlocking elements, when securely fastened together, prevent access to the third and fourth tabs.

* * * * *